US005946827A

United States Patent [19]

Okajima

[11] Patent Number: 5,946,827

[45] Date of Patent: Sep. 7, 1999

[54] SNOWBOARD BOOT ANKLE AND HEEL SUPPORT

[75] Inventor: Shinpei Okajima, Izumi, Japan

[73] Assignee: Shimano Inc., Sakai, Japan

[21] Appl. No.: 09/127,913

[22] Filed: Aug. 3, 1998

[51] Int. Cl.[6] ..... A43B 7/20; A43B 5/04

[52] U.S. Cl. ..... 36/58.5; 36/89; 36/117.6

[58] Field of Search ..... 36/58.5, 89, 117.6, 36/115, 58.6

[56] References Cited

U.S. PATENT DOCUMENTS

| | | |
|---|---|---|
| 2,531,763 | 11/1950 | Andre . |
| 3,377,721 | 4/1968 | Johnson . |
| 3,566,486 | 3/1971 | Conway . |
| 4,676,011 | 6/1987 | O'Rourke et al. . |
| 4,924,605 | 5/1990 | Spademan . |
| 5,105,565 | 4/1992 | Barret . |
| 5,761,830 | 6/1998 | Condini . |

FOREIGN PATENT DOCUMENTS

| | | |
|---|---|---|
| 0 753 268 A2 | 1/1997 | European Pat. Off. . |
| 804 900 | 5/1951 | Germany . |
| WO 98/31247 | 7/1998 | WIPO . |

*Primary Examiner*—Ted Kavanaugh

*Attorney, Agent, or Firm*—Shinjyu An Intellectual Property Firm

[57] ABSTRACT

A snowboard boot is formed with an ankle and heel support. The boot includes a sole portion and an upper portion fixed to the sole portion. The ankle and heel support includes a strap member that is formed with first and second lacing loops and an ankle strap portion which extends between the first and second lacing loops. A first support leg extends downward from the first lacing loop and a second support leg extending downward from the second lacing loop. The first and second support legs are fixed to a lower inside portion of the upper portion proximate the sole portion. The ankle strap portion is configured to wrap around the back side of an ankle portion of a foot above a heel portion of the foot and with the first and second lacing loops laced, the ankle and heel support provides firm engagement between the foot and boot.

3 Claims, 3 Drawing Sheets

SNOWBOARD BOOT ANKLE AND HEEL SUPPORT

BACKGROUND OF THE INVENTION

A. Field of the Invention

The invention relates to a support within a boot, and in particular to a support which wraps around the ankle portion of a users foot for supporting the ankle and heel of the foot within the boot.

B. Description of the Related Art

Snowboard boots and ski boots are usually formed with a sole and an upper portion. The upper portion is often made of a pliable material such as leather or a leather-like material. The upper portion is usually formed with central opening. A tongue is formed on a lower end of the opening, the tongue extending between the sides of the opening. The sides of the opening are usually formed with a combination of hooks, loops or eyelets through which a lace extends. The lace typically extends through the hooks, loops or eyelets in a criss-cross manner, going from side to side through the loops and eyelets. Typically the eyelets or loops are formed on opposite sides of the opening in equal numbers at equally spaced apart intervals, defining pairs of eyelets or loops.

When tightening the boots, the upper portion of the boot is drawn in tight around the lower leg above the ankle. However, the size of a various feet below the calf muscle varies from person to person. Therefore, while the upper portion of the boot may be secured about the lower calf of a persons leg, the ankle and heel of the foot might not be so secure within the boot.

When snowboarding and skiing it is important for the foot to be secure within the boots in order to provide the snowboarding individual with a maximum amount of control. Turns and stops in snowboarding require that the snowboarding individual be able to lean in various directions and have the leaning movement translate instantly into movement of the snowboard. In particular, snowboarding requires forward leaning (leaning over the toe) and rearward leaning (leaning back over the heel). Therefore, it is important that the snowboard boots worn by the individual be securely fasted to all portions of each of the individual's feet.

Most snowboard boots are produced in standard sizes. Therefore, a perfect fit is not always possible for every individual. Therefore, those persons with lower leg muscles and ankles that do not conform to standard size boots might not have the absolute best secure fit of boots required for responsive, high performance snowboarding or skiing. Custom boots made to fit to an individuals foot and leg contours are expensive and can only be used by the fitted person. Therefore, some individuals may have difficulty buying or renting boots which provide that individual with ideal support for the foot when snowboarding.

SUMMARY OF THE INVENTION

One object of the invention is to secure the ankle and heel portion of a foot within a boot without incurring the expense of custom made boots.

In accordance with one aspect of the present invention, a boot support includes a strap member formed with a first lacing loop, a second lacing loop and an ankle strap portion which extends between the first and second lacing loops. A first support leg extends downward from the first lacing loop and a second support leg extends downward from the second lacing loop. The ankle strap portion is configured to wrap around the back side of an ankle portion of a foot above a heel portion of the foot and the first and second lacing loops are configured for a lace to extend therethrough for lacing an article of footwear equipt with the strap member. Further, the first and second support legs are configured for attachment to an inner portion of the article of footwear proximate a portion of the article of footwear below an ankle portion of the foot.

Preferably, the boot support further includes an ankle support pad. A lower portion of the ankle support pad is fixed to the ankle strap portion for engagement with a backside of a leg above the ankle of the foot. An upper support strap is connected to an upper portion of the ankle support pad. The upper support strap is formed at respective ends thereof with third and fourth lacing loops that are configured for the lace to extend therethrough for lacing the article of footwear.

Preferably, the ankle support pad is formed of neoprene and the ankle strap portion and the first and second support legs being formed of a single piece of synthetic leather.

In accordance with another aspect of the present invention, a snowboard boot has an ankle and heel support. The boot and support include a sole portion and an upper portion fixed to the sole portion. The ankle and heel support includes a strap member formed with a first and second lacing loops and an ankle strap portion which extends between the first and second lacing loops. A first support leg extend downward from the first lacing loop and a second support leg extends downward from the second lacing loop. The first and second support legs are fixed to a lower inside portion of the upper portion proximate the sole portion. The ankle strap portion is configured to wrap around the back side of an ankle portion of a foot above a heel portion of the foot and the first and second lacing loops are configured for a lace to extend therethrough for lacing with lacing means formed on the upper portion.

Preferably, the strap member further includes an ankle support pad and a lower portion of the ankle support pad that is fixed to the ankle strap portion for engagement with a backside of a leg above the ankle of the foot. An upper support strap is connected to an upper portion of the ankle support pad and the upper support strap is formed at respective ends thereof with third and fourth lacing loops that are configured to receive the lace such that the lace is extendable therethrough thus lacing the third and fourth lacing loops with the lacing means in the upper portion.

Preferably, the ankle support pad is formed of neoprene and the ankle strap portion and the first and second support legs being formed of a single piece of synthetic leather.

These and other objects, features, aspects and advantages of the present invention will become more fully apparent from the following detailed description of the present invention when taken in conjunction with the accompanying drawings where like reference numerals denote corresponding parts throughout the drawing.

DETAILED DESCRIPTION OF THE PREFERRED EMBODIMENTS

Figure 1:
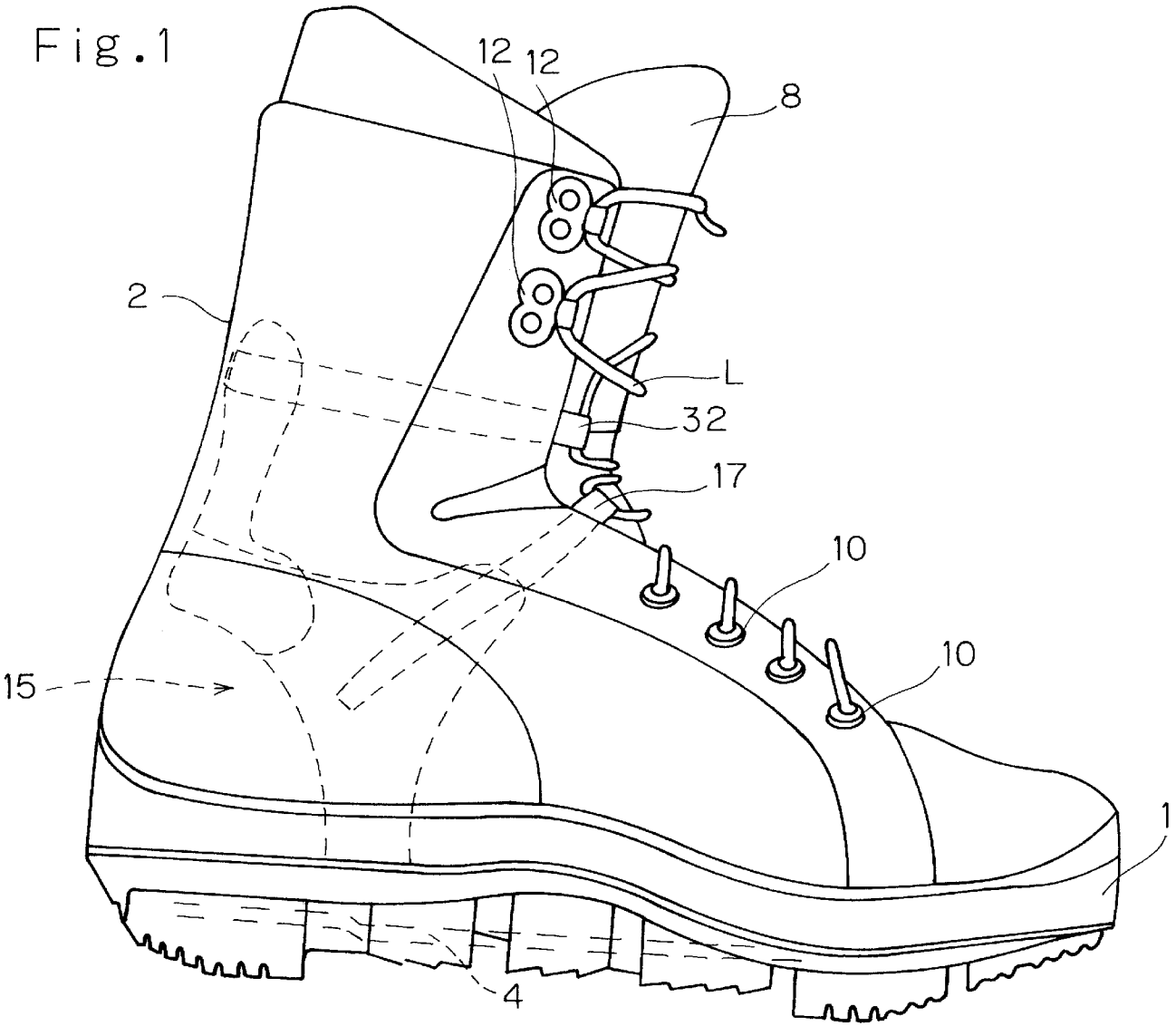
FIG. 1 is a side view of a snowboard boot which includes an ankle and heel support member in accordance with the present invention.

A snowboard boot is depicted in FIG. 1. The snowboard boot includes a sole portion 1 and an upper portion 2 fixed to the sole portion 1. Typically, the sole portion 1 is made from a stiff rubber-like material and, in the embodiment depicted, includes an engagement member 4 which is configured for engagement with a fastening mechanism (not shown) disposed on a snowboard (not shown). The fastening mechanism is of a type known as a CLICKER™ mechanism manufactured by Shimano Inc., Osaka, Japan. The portions of the upper portion 2 are also generally rigid in order to support a foot while snowboarding. Generally, the upper portion 2 may be made of any of a variety of materials such as plastic materials, leather and/or synthetic leather materials.

The front of the upper portion 2 of the boot is formed with an opening and a tongue 8 which extends throughout the length of the opening. A lace L is laced through eyelets 10 formed on each side of the opening and through hooks 12. The lace L is used for tightening the boot on a foot of a snowboarding individual.

Figure 2:
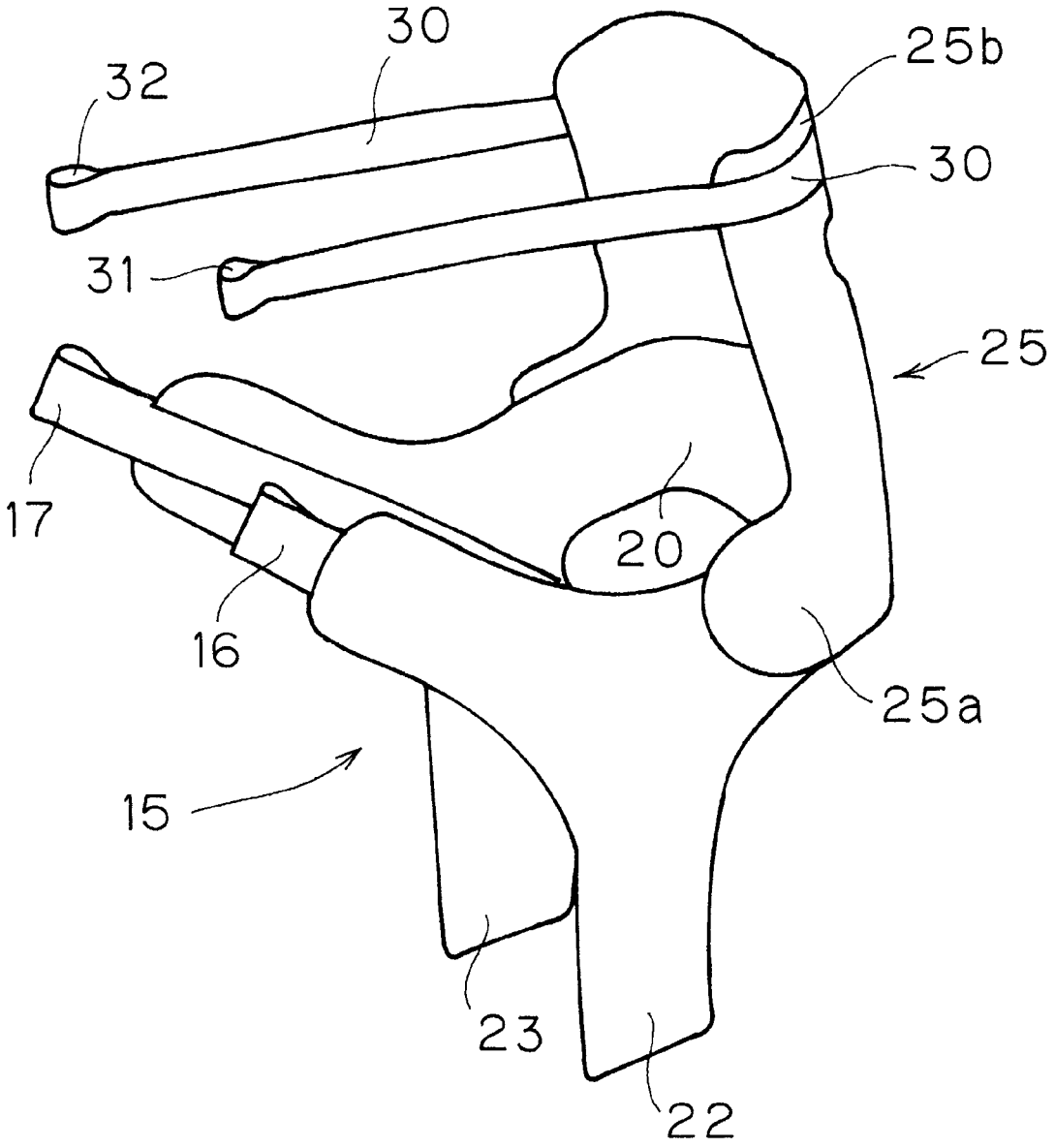
FIG. 2 is a perspective view of the ankle and heel support member shown removed from the snowboard boot.
Figure 3:
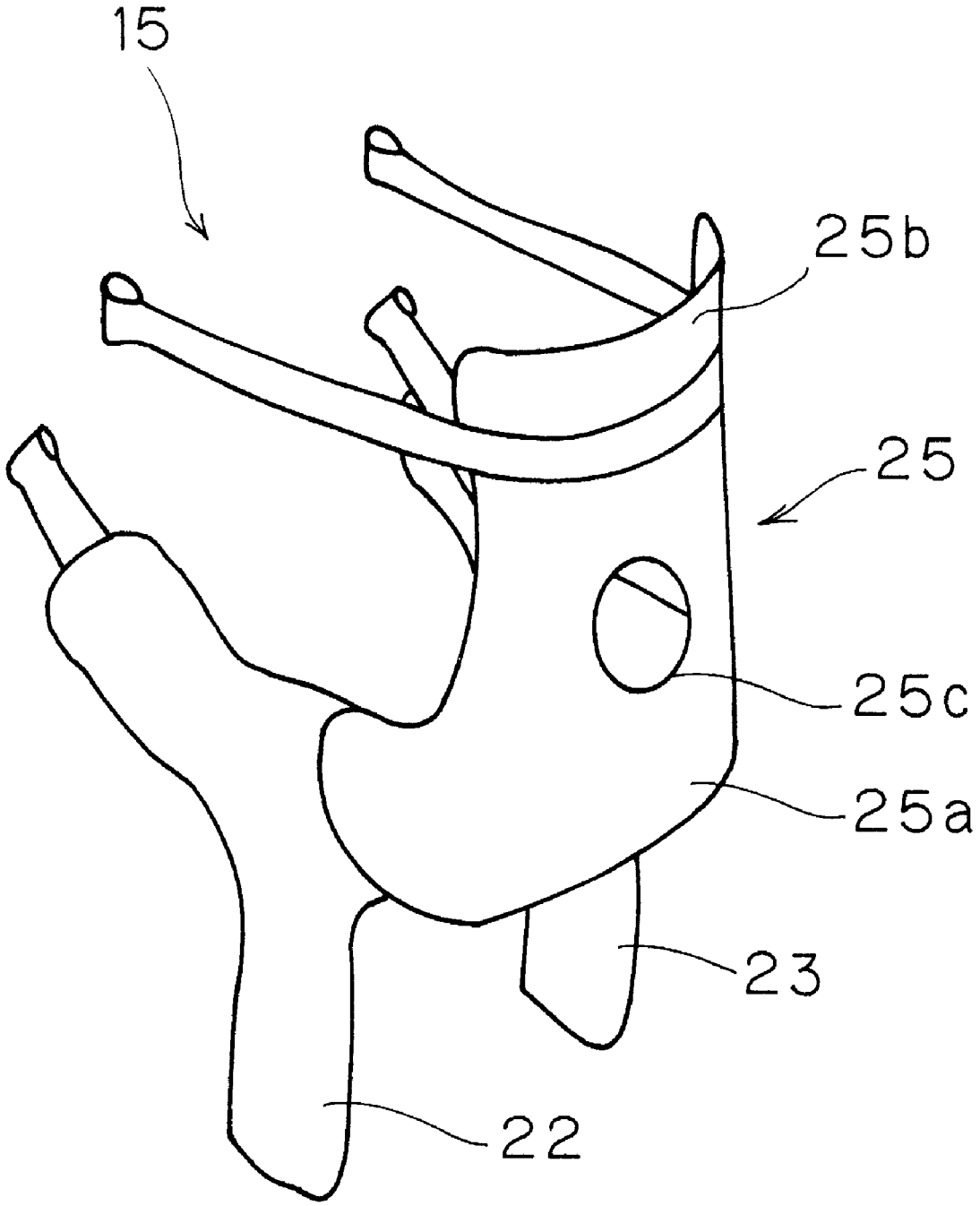
FIG. 3 is a perspective view showing the back side of the ankle and heel support member depicted in FIG. 2.

Within the upper portion 2 of the boot, as shown in FIGS. 2 and 3, is a strap member 15 formed with a first lacing loop 16, a second lacing loop 17 and an ankle strap portion 20 which extends between the first and second lacing loops 16 and 17. A first support leg 22 extends downward from the first lacing loop 16 and a second support leg 23 extends downward from the second lacing loop 17. The first and second support legs 22 and 23 are fixed to a lower inside portion of the upper portion 2 proximate the sole portion 4, as is indicated in FIG. 1. The first and second support legs 22 and 23 may be glued and/or stitched to the lower inside of the upper portion 2. Further, although not depicted, the legs 22 and 23 may alternatively extend to form a loop which extends under a foot (not shown) of a snowboarding individual and be fixed to the upper portion of the sole 1.

As is apparent in FIG. 1, the ankle strap portion 20 is configures to wrap around the back side of an ankle portion of the foot (not shown) above a heel portion of the foot. The lace L extends through the first and second lacing loops 16 and 17, although in FIG. 1, the lace L is shown only extending through the second lacing loop 17.

The strap member 15 also includes an ankle support pad 25 which may be formed with a variety of materials, however in the preferred embodiment the ankle support pad 25 is formed from neoprene. A lower portion 25*a* of the ankle support pad 25 is fixed to the ankle strap portion 20 for engagement with a backside of a leg above the ankle of the foot (not shown). As is clear in FIG. 3, the ankle support pad 25 includes an aperture 25*c*. An upper support strap 30 is connected to an upper portion 25*b* of the ankle support pad 25. The upper support strap is formed at respective ends thereof with third and fourth lacing loops 31 and 32. The lace L extends through the third and fourth lacing loops 31 and 32.

As is clear in FIG. 2, the ankle strap portion 20 and the first and second support legs are formed of a single piece of material, such as synthetic leather.

The strap member 15 is only connected to the boot itself via the first and second support legs 22 and 23 and is other wise loose and freely moveable within the upper portion 2. The only constraint to movement of the strap member 15 within the boot other than the connection between the upper portion 2 and the first and second legs 22 and 23 is due to the lace L extending through the loops 16, 17, 31 and 32.

The present invention operates as follows. First, with the lace L loose, an individual inserts his or her foot into the upper portion 2 of the boot. The foot also is inserted into the central portion of the strap member 15 such that the ankle strap portion 20 and the upper support strap 30 wrap around the lower leg proximate the ankle. The lace L is then drawn tight. The lace L extends through the loops 16, 17, 31 and 32 and therefore the ankle support pad 25 is firmly engaged with the back of the leg proximate the ankle. The ankle strap portion 20 and the upper support strap 30 firmly engage the lower leg and foot of the individual once the lace L is tightened thus providing a more firm engagement between the boot and the foot of the individual. This firm engagement facilitates improved control on a snowboard since there can be virtually no movement of the foot within the boot. In snowboarding steering is effected by leaning forward or backward with respect to the boot. Therefore, for example, when leaning forward to make a snowboard turn, movement of the foot and heel of the foot within the boot is undesirable. The strap member 15 of the present invention provides for more firm engagement between the foot and the boot making possible improved steering control when snowboarding.

Further, boots equipped with the strap member 15 provide for the above described support without the expense of having custom fit boots prepared. Therefore, the strap member 15 is ideal for those individuals who have difficulty finding affordable boots that support non-standard sized bodily proportions. Further, the strap member 15 is ideal for rental boots which are used with a variety of individuals who do not choose to purchase their own pair of boots.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A snowboard boot having an ankle and heel support, the boot comprising:

a sole portion;

an upper portion fixed to said sole portion;

a strap member disposed within said upper portion, said strap member being formed with a first lacing loop, a second lacing loop, an ankle strap portion which extends between said first and second lacing loops, a first support leg extending downward from said first lacing loop and a second support leg extending downward from said second lacing loop, said first and second support legs being fixed to a lower inside portion of said upper portion proximate said sole portion;

wherein said ankle strap portion is configured to wrap around the back side of an ankle portion of a foot above a heel portion of the foot, said first and second lacing loops are configured for a lace to extend therethrough for lacing with lacing means formed on said upper portion, and said ankle strap portion is free to move within said upper portion being confined ly attachment to said first lacing loop, said second lacing loop, said first support leg and said second support leg.

2. The snowboard boot as set forth in claim 1, wherein said strap member further comprises:

an ankle support pad, a lower portion of said ankle support pad being fixed to said ankle strap portion for engagement with a backside of a leg above the ankle of the foot; and an upper support strap connected to an upper portion of said ankle support pad, said upper support strap being formed at respective ends thereof with third and fourth lacing loops that are configured to receive the lace such that the lace is extendable therethrough thus lacing said third and fourth lacing loops with said lacing means in said upper portion; and wherein said ankle support pad is free to move within said upper portion, being confined against movement only by connection to said upper support strap and said ankle strap portion.

3. The boot support as set forth in claim 2, wherein said ankle support pad is formed of neoprene and said ankle strap portion and said first and second support legs being formed of a single piece of synthetic leather.

* * * * *